US010301573B2

(12) United States Patent
Shoshany et al.

(10) Patent No.: US 10,301,573 B2
(45) Date of Patent: May 28, 2019

(54) CANDLE WITH WATER IN WAX

(75) Inventors: Haggai Shoshany, Kfar Tavor (IL); Amnon Shoshani, Caesarea (IL)

(73) Assignee: Smartech Ltd., Caesarea Industrial Park (IL)

( * ) Notice: Subject to any disclaimer, the term of this patent is extended or adjusted under 35 U.S.C. 154(b) by 1260 days.

(21) Appl. No.: 12/424,633

(22) Filed: Apr. 16, 2009

(65) Prior Publication Data

US 2009/0263756 A1 Oct. 22, 2009

Related U.S. Application Data

(60) Provisional application No. 61/045,329, filed on Apr. 16, 2008.

(51) Int. Cl.
*F23D 3/16* (2006.01)
*C11C 5/00* (2006.01)

(52) U.S. Cl.
CPC ..... *C11C 5/002* (2013.01); *C11C 5/008* (2013.01)

(58) Field of Classification Search
USPC ..... 431/288, 289; 44/275, 280, 311
See application file for complete search history.

(56) References Cited

U.S. PATENT DOCUMENTS

| | | | | |
|---|---|---|---|---|
| 2,892,732 | A * | 6/1959 | Rockland | 106/277 |
| 3,000,753 | A | 9/1961 | Rockland | |
| 3,266,272 | A * | 8/1966 | Fredericks | 431/126 |
| 3,660,128 | A * | 5/1972 | Sheldahl | 106/271 |
| 3,677,808 | A * | 7/1972 | Sheridan | 106/660 |
| 4,622,118 | A * | 11/1986 | Chimenti et al. | 204/562 |
| 6,066,186 | A * | 5/2000 | Matsumoto | 44/301 |
| 6,864,349 | B2 * | 3/2005 | Pavlin et al. | 528/310 |
| 2006/0100696 | A1 * | 5/2006 | Atanasoska et al. | 623/1.44 |
| 2009/0300969 | A1 * | 12/2009 | Martin | 44/301 |
| 2014/0199646 | A1 * | 7/2014 | Beadles | C11C 5/002 431/288 |

FOREIGN PATENT DOCUMENTS

| | | |
|---|---|---|
| CN | 1238147 | 12/1999 |
| DE | 837916 | 5/1952 |
| EP | 1518917 | 3/2005 |
| JP | 58063798 | 4/1983 |

OTHER PUBLICATIONS

W Liu, et al. Formation and stability of paraffin oil-in-water nano-emulsions prepared by the emulsion inversion point method, Jul. 26, 2006, Journal of Colloid and Interface Science, 303 (2006).*
PCT/GB2007000132: Martin, Water-In-Oil Emulsions, Methods, and Uses of Emulsiifying Agents, Jan. 18, 2007.*

* cited by examiner

*Primary Examiner* — Avinash A Savani
(74) *Attorney, Agent, or Firm* — Dekel Patent Ltd.; David Klein

(57) ABSTRACT

A method for producing a candle shaped from a wax, wherein a dispersion of water droplets is purposely added within the wax.

18 Claims, No Drawings

CANDLE WITH WATER IN WAX

CROSS-REFERENCE TO RELATED APPLICATIONS

This application claims priority under 35 USC § 119 to U.S. Provisional Patent Application 61/045,329, filed Apr. 16, 2008, incorporated herein by reference.

FIELD OF THE INVENTION

The present invention relates generally to wax candle manufacture, and particularly to a method for manufacturing candles from wax dispersed with water.

BACKGROUND OF THE INVENTION

As is well known in the art, wax, especially paraffin wax, is the main constituent in most candles.

From ancient times, wax has been melted and poured into molds where it cools and hardens to a desired solid candle form. During the 20th century, extrusion and/or press molding of solid wax particles below their melt temperature have become additional major production methods for making candles.

From the start of the 21$^{st}$ century, due to steep rises in crude oil prices, the cost of paraffin wax has soared. Prices of all waxes and wax-like products, such as fossil, synthetic plant and animal waxes, have also soared. There is thus a need in the candle industry to significantly decrease raw material costs.

One obvious way of decreasing raw material costs is to reduce the size of the candle. However, there is a relationship between parameters, such as but not limited to, the size of flame, the type and size of wick, the rate the wax burns, and candle weight which determine the length of time the candle burns. Accordingly, reducing the size of the candle forces the manufacturer to take steps, such as adjusting the properties of the wick and/or flame, in order to maintain the same length of time that the candle burns. In addition, the candle manufacturer must take into account various demands of the consumer, such as but not limited to, size, weight, burn time, flame properties, etc. There are no easy or obvious solutions to the problems faced by the candle manufacturer to reduce costs without compromising candle properties.

A known problem in the prior art is keeping water from being mixed with the wax in the candle manufacture, such as water that can get trapped in the vicinity of the wick. It is well known in the prior art that water in the candle wax is undesired and can result in phenomena, such as flame flickering or sputtering, wick clogging, smoking or others.

SUMMARY OF THE INVENTION

The present invention seeks to provide a novel method for manufacturing candles from wax dispersed with water droplets, as is described more in detail hereinbelow. In direct contradistinction to the accepted norms of the prior art, in the present invention water droplets are deliberately added to the wax raw material without compromising the quality of the candle. Without being limited to any theory of how the invention works, it is believed that the invention succeeds in maintaining candle quality because the water is added as droplets (small drops). The small drops blend sufficiently well with the wax so as to maintain candle quality.

In addition, the present invention enables candle users to reduce their wax consumption thus contributing to the global effort to reduce the emission of greenhouse gases.

There is thus provided in accordance with an embodiment of the present invention a method for saving on wax used in producing a candle, including producing a candle from a wax, wherein a dispersion of water droplets is purposely added within the wax (e.g., to replace candle wax by mass).

In accordance with an embodiment of the present invention a reference candle is defined as a candle produced from the wax without addition of water droplets, and wherein the candle produced with the water droplets and the reference candle burn at approximately equal burn rates, burn rate being defined as total mass loss of candle divided by burn time. ("Approximately equal" is preferably within a range of ±40%, preferably ±30%, more preferably ±20%, more preferably ±10%, more preferably ±5%.)

In accordance with an embodiment of the present invention a reference candle is defined as a candle produced from the wax without addition of water droplets, and wherein grade points are allotted to the reference and water-containing candles as a function of burn rate, flame size, sputtering, flickering, excess smoke, wick clogging, and wick drowning, and wherein the grade points of the candle produced with the water droplets differ from the grade points of the reference candle in a range of 0-40% (or alternatively 0-20% or 0-10%).

DETAILED DESCRIPTION OF EMBODIMENTS

It was surprisingly found that one can deliberately add a dispersion of small or minutely divided water droplets within the wax and form a candle with consumer-acceptable properties, that is, properties that are not noticeable different from prior art candles that have no water content.

Without limitation, the minutely divided droplets can be of a droplet size smaller than 500 microns, preferably smaller than 100 microns, preferably smaller than 50 microns, preferably smaller than 25 microns, preferably smaller than 10 microns, preferably smaller than 5 microns, and preferably smaller than 1 micron, all of which provide satisfactory results. The water added to the wax can be in the form of, without limitation, water in wax suspension, emulsion, dispersion, etc. The added water still allows forming a candle with consumer-acceptable properties, such as acceptably low levels of sputtering and/or flickering (or possibly even no noticeable sputtering and/or flickering), and enables manufacturers to maintain desirable candle characteristics, such as appearance, volume, weight, flame size and burn time, etc., while using less wax.

It was found that up to 50% water can be incorporated within the wax; however, best results were achieved using 0.1-25% water (other embodiments use 0.1 to 20% or 30%).

Other advantages for incorporation of water in the wax were noticed. Water dispersed in wax (as a suspension, emulsion, dispersion among others) may enable manufacturers to use higher oil content waxes (slack waxes, scale waxes and/or blends thereof), thus further reducing raw material costs. Water dispersed in wax enables manufacturers to add water soluble additives in the manufacturing process instead of wax soluble additives. The term "adding" encompasses mixing, coating, dissolving, pouring, or any other action to make the additive part of the finished candle product.

Wax herein encompasses tallow and/or wax of fossil origin, such as but not limited to, paraffin wax, montan wax, etc., or of plant origin, such as but not limited to, soy wax, etc., or of animal origin, such as but not limited to, bee wax, fat wax, etc., or synthetic wax, such as but not limited to, fisher tropsch wax, polyethylene wax, polypropylene wax, sterine wax, stearic wax, etc. or any other wax-like material.

Without derogating from the aforesaid, wax herein may encompass, without limitation, soft wax, slack wax, scale wax, partially refined wax, fully refined wax, oxidized wax, bleached wax, unbleached wax, macrocrystalline wax, microcrystalline wax and others.

Wax blend herein may encompass any combination of at least two types of waxes, or any combination of wax and other constituents such as but not limited to, oil, etc.

The term dispersion is used in the specification and claims to encompass suspension, emulsion and dispersion, among other types of mixtures.

"Solution" herein is defined as a homogenous liquid of miscible materials in which wax is dissolved in a solvent. The wax is in its molecular or ion form. It is noted that the weight or volume ratio of the solvent may be 0.1-99.9% of the solution. It is also noted that a solution may be formed at an elevated temperature in which the wax is in liquid form and then used as a solid at room temperature.

"Emulsion" herein is defined as a stable dispersion of immiscible materials. It is noted that some water in wax emulsions may require emulsifiers to maintain stability. The emulsifiers prevent the water particles from adhering to or merging with themselves. It is noted that an emulsion may be formed at an elevated temperature in which wax is in liquid form and then used as a solid at room temperature.

"Suspension" herein is defined as a buoyant dispersion of immiscible materials. It is noted that water in wax suspensions may require constant agitation during the manufacturing process and during storage in order to prevent improper inclusion such as but not limited to merging, immersion, floatage, of the water in the wax. It is noted that a water-in-wax suspension may be formed at an elevated temperature in which wax is in liquid form and then used as a solid at room temperature.

It was surprisingly found that water dispersed in the wax may reduce the wick drowning phenomenon, wherein the wick leans or falls to drown in the pool of molten wax resulting in premature extinguishing of the candle flame.

The invention enables the wax candle manufacturer to manufacture candles at lower costs, using less wax, and still maintain quality and standards expected by the consumer and industry. For example, tea light candles made according to the invention will contain less wax than prior art tea light candles, yet will exhibit qualities expected and accepted by the consumer, such as but not limited to, appearance, volume, weight, burn time, and flame size. As another example, candles that are sold by weight (colored or non-colored, scented or non-scented, etc.) and which are made according to the invention will contain less wax than their prior art counterparts, yet will exhibit qualities expected and accepted by the consumer, such as but not limited to, appearance, volume, weight, burn time, and flame size.

The invention may be better understood by the following non limiting examples:

Grading of candles performance was done comparatively with reference candles of the same wax composition and similar shape and weight. Maximum grade is 10. Grade points are lowered if there is some adverse effect as regards burn rate, sputtering, flickering, flame size, excess smoke, wick clogging, wick drowning, and more. Burn rate is calculated as the total mass loss of a candle divided by burn time. Therefore, when a water-containing candle and a reference candle without water burn at the same rate it means that the water-containing candle burns less wax since its mass comprises water that has replaced wax.

Generally a grade of 6 or higher is acceptable by the consumers of the candle industry.

Example 1

Tap water was added to molten paraffin wax (congealing point 58° C.) using a batch high shear mixer (Ystral equipment) The water containing wax was poured into tea-lights and cooled to room temperatures within about 10 minutes.

Grade results are shown in Table 1.

TABLE 1

| Candle Number | Mixer RPM | Mixing time [seconds] | % water | Candle grade |
|---|---|---|---|---|
| 300 reference | — | — | 0 | 9 |
| 301 | 24000 | 60 | 10 | 9 |

Table 1 shows that candles of equivalent performance can be achieved in water-containing candles under these terms.

Example 2

Tap water and alcoholic additive was mixed forming a solution. The alcohol containing solution was mixed with molten paraffin wax (congealing point 55° C.) using a batch high sheer mixer (Ystral Equipment) at various solution loads. The mixing was operated for 45 seconds within a 600 ml candle jar. The mixing was stopped after 45 seconds, a wick was inserted, and the candle jar cooled below the wax's freezing temperature within 20 minutes.

Grade results of the candles are shown in Table 2:

TABLE 2

| Candle Number | Mixer RPM | Mixing time [seconds] | % alcohol in the water | % water | Candle grade |
|---|---|---|---|---|---|
| 498 | 24000 | 45 | 2 | 10 | 8 |
| 499 | 24000 | 45 | 10 | 10 | 10 |
| 500 reference | | | | 0 | 8 |

Table 2 shows that water containing candles achieved equivalent performance to regular candles and that candles with an alcoholic additive improves candle's performance compared to under these terms.

Example 3

Tap water and wax were mixed using a batch ultrasonic horn (COLE PALMER Equipment). The ultrasonic horn was operated at 100% amplitude for 45 seconds creating suspensions. The suspensions were cooled below the wax congealing point within 30 seconds. The cold suspension and reference candle material were pressed into tea-light candles.

Grade results of the candles are shown in Table 3:

TABLE 3

| Candle Number | Ultrasonic amplitude [%] | Mixing time [seconds] | Wax congealing point [° C.] | % water | Candle grade |
|---|---|---|---|---|---|
| 334 | 100 | 45 | 55 | 20 | 9 |
| 351 reference | — | — | 55 | 0 | 9 |

Table 3 shows that ultrasonic mixing produces equivalent performance candles at water content of 20% under these terms.

Example 4

De-ionized water and wax were mixed using a continuous flow and ultrasonic device (Hielscher Equipment). The ultrasonic device was operated at 100% amplitude with a booster. The suspensions and reference were poured into tea-light candles, which cooled below their congealing point within about 10 minutes.

Grade results of the candles are shown in Table 4:

TABLE 4

| Candle Number | Ultrasonic amplitude [%] | Wax congealing point [° C.] | % water | Candle grade |
|---|---|---|---|---|
| 539 | 100 + booster | 58 | 15 | 9 |
| 578 reference | 100 + booster | 58 | 0 | 9 |

Table 4 shows that Ultrasonic mixer can continuously produce water containing waxes of equivalent quality under these terms.

Example 5

Emulsifiers of the type GMS (Glycerin monostearate) were added to molten paraffin waxes using a batch stirrer (Ika Equipment) forming a solution. The emulsifier-containing waxes were mixed with distilled water using a batch ultrasonic device (Hielscher equipment) at 45 seconds mixing time. The water-wax emulsions and reference were poured to tea-lights which cooled below their congealing point within about 10 minutes.

Grade results of the candles are shown in Table 5:

TABLE 5

| Candle Number | Wax congealing point [° C.] | Emulsifier content [%] | % water | Candle grade |
|---|---|---|---|---|
| 1101 reference | 56 | 0 | 0 | 7 |
| 1111 | 56 | 0.5 | 10 | 7 |
| 1105 | 56 | 1.0 | 10 | 9 |

Table 5 shows that GMS emulsifier has positive influence on candle performance under these terms.

Example 6

Emulsifiers of fatty acids derivatives type were added to molten paraffin waxes using a batch stirrer (Ika Equipment) forming a solution. The emulsifier-containing waxes were mixed with tap water using a batch ultrasonic device (Hielscher Equipment) for 45 seconds mixing time, forming an emulsion. The water in wax emulsion and the reference were poured into tea-lights which cooled below their congealing point within about 10 minutes.

Grade results of the candles are shown in Table 6:

TABLE 6

| Candle Number | Wax congealing point [° C.] | Wax emulsifier content [%] | % water | Candle grade |
|---|---|---|---|---|
| 1234 | 56 | 0.5 | 10 | 7 |
| 1237 | 56 | 1.0 | 10 | 8 |
| 1240 reference | 56 | 0.0 | 10 | 6 |

Table 6 it shows that fatty acid derivative emulsifier may improve candle performance under these terms.

Example 7

Tap water and wax were mixed using a continuous high sheer homogenizer (ROSS rotor-stator equipment). The made suspensions, and the reference were poured into tea-light candles, which cooled below their congealing point within about 10 minutes.

Grade results of the candles are shown in Table 7:

TABLE 7

| Candle Number | Wax congealing point [° C.] | % water | Candle grade |
|---|---|---|---|
| 1325 reference | 58 | — | 9 |
| 1332 | 58 | 10 | 9 |

Table 7 shows that rotor-stator equipment enables the production of equivalent candles under these terms.

It will be appreciated by persons skilled in the art that the present invention is not limited by what has been particularly shown and described hereinabove. Rather the scope of the present invention includes both combinations and sub-combinations of the features described hereinabove as well as modifications and variations thereof which would occur to a person of skill in the art upon reading the foregoing description and which are not in the prior art.

What is claimed is:

1. A method for saving on wax used in producing and burning a candle, comprising:

producing a candle from a wax, wherein a dispersion of water droplets is purposely added within the wax as a replacement of wax by mass thereby saving on the wax used in producing the candle, wherein a reference candle is defined as a candle produced from the wax without addition of water droplets as a replacement of wax by mass, and wherein the candle produced with the water droplets and the reference candle burn at approximately equal burn rates, burn rate being defined as total mass loss of candle divided by burn time, and the candle produced with the water droplets burns less wax than the reference candle by an amount equal to said water droplets.

2. The method according to claim 1, wherein the dispersion of water droplets is purposely added within the candle wax to replace candle wax by mass.

3. The method according to claim 1, wherein a reference candle is defined as a candle produced from the wax without addition of water droplets, and wherein grade points are allotted to the reference and water-containing candles as a function of burn rate, flame size, sputtering, flickering, excess smoke, wick clogging, and wick drowning, and wherein the grade points of the candle produced with the water droplets differ from the grade points of the reference candle in a range of 0-40%.

4. The method according to claim 1, wherein a reference candle is defined as a candle produced from the wax without addition of water droplets, and wherein grade points are allotted to the reference and water-containing candles as a function of burn rate, flame size, sputtering, flickering, excess smoke, wick clogging, and wick drowning, and wherein the grade points of the candle produced with the water droplets differ from the grade points of the reference candle in a range of 0-20%.

5. The method according to claim 1, wherein a reference candle is defined as a candle produced from the wax without addition of water droplets, and wherein grade points are allotted to the reference and water-containing candles as a function of burn rate, flame size, sputtering, flickering, excess smoke, wick clogging, and wick drowning, and wherein the grade points of the candle produced with the water droplets differ from the grade points of the reference candle in a range of 0-10%.

6. The method according to claim 1, wherein said water droplets are smaller than 500 microns.

7. The method according to claim 1, wherein said water droplets are smaller than 100 microns.

8. The method according to claim 1, wherein said water droplets are smaller than 50 microns.

9. The method according to claim 1, wherein said water droplets are smaller than 25 microns.

10. The method according to claim 1, wherein said water droplets are smaller than 10 microns.

11. The method according to claim 1, wherein said water droplets are smaller than 5 microns.

12. The method according to claim 1, wherein said water droplets are smaller than 1 micron.

13. The method according to claim 1, wherein said water droplets are added to the wax as a water-in-wax suspension.

14. The method according to claim 1, wherein said water droplets are added to the wax as a water-in-wax emulsion.

15. The method according to claim 1, wherein said water droplets are added to the wax as a water-in-wax dispersion.

16. The method according to claim 1, wherein said candle comprises 0.1-50% water.

17. The method according to claim 1, wherein said candle comprises 0.1-30% water.

18. The method according to claim 1, wherein said candle comprises 0.1-20% water.

* * * * *